US006915978B2

(12) United States Patent
Nekipelov

(10) Patent No.: US 6,915,978 B2
(45) Date of Patent: Jul. 12, 2005

(54) METHOD OF ROD COIL FORMING AND SET OF EQUIPMENT FOR ITS REALIZATION

(75) Inventor: Vladimir Stanislavovich Nekipelov, Moscow (RU)

(73) Assignee: OOO MT Group, Moscow (RU)

( * ) Notice: Subject to any disclaimer, the term of this patent is extended or adjusted under 35 U.S.C. 154(b) by 219 days.

(21) Appl. No.: 10/275,964

(22) PCT Filed: Jan. 17, 2001

(86) PCT No.: PCT/RU01/00017

§ 371 (c)(1),
(2), (4) Date: Nov. 18, 2002

(87) PCT Pub. No.: WO01/89731

PCT Pub. Date: Nov. 27, 2001

(65) Prior Publication Data

US 2004/0007039 A1 Jan. 15, 2004

(30) Foreign Application Priority Data

May 24, 2000 (RU) ..... 2000112837

(51) Int. Cl.[7] ..... B21C 47/24
(52) U.S. Cl. ..... 242/363; 242/437
(58) Field of Search ..... 242/363, 361.2, 242/361.3, 362.2, 437

(56) References Cited

U.S. PATENT DOCUMENTS

| | | | | |
|---|---|---|---|---|
| 3,647,153 A | | 3/1972 | Schofield | 242/361 |
| 4,437,620 A | * | 3/1984 | Ozawa | 242/363 |
| 4,641,512 A | * | 2/1987 | Duri | 72/201 |
| 4,747,557 A | | 5/1988 | Fujimaki | 242/362 |

FOREIGN PATENT DOCUMENTS

| | | |
|---|---|---|
| DE | 1925800 | 11/1970 |
| DE | 3347031 A1 | 11/1984 |
| DE | 3819981 A1 | 12/1989 |

(Continued)

OTHER PUBLICATIONS

A. A. Kugushin et al, metallurgiya, 1982, High–Grade Rolling of Rod, pp. 26–31.

*Primary Examiner*—Emmanuel Marcelo
(74) *Attorney, Agent, or Firm*—Jacobson Holman PLLC

(57) ABSTRACT

This invention relates to rolling and in particular to the process of rod coil forming, for instance, of steel and nonferrous metals, and to a set of equipment for its realization.

Figure 1:
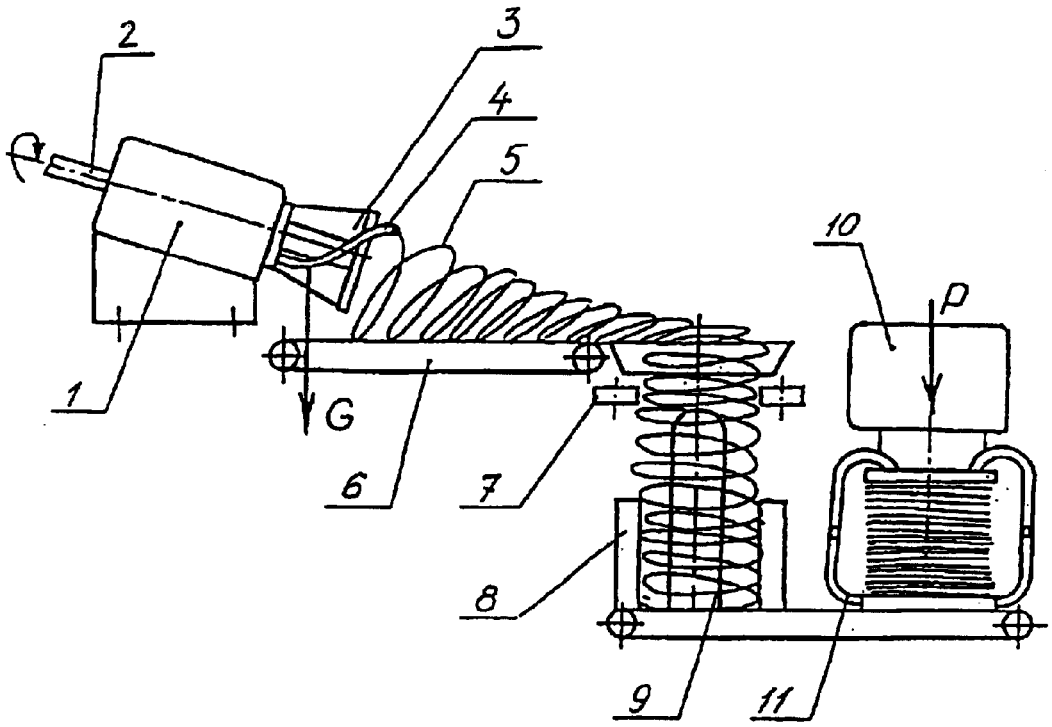
Fig. 1 PRIOR ART

The method of rod coil forming includes continuous rod feeding through a wire-rod guide, forming of waps with a variable diameter by means of speed variation of wire-rod guide rotation and stacking of waps by horizontal layers throughout the height of a coil. The difference of the applied method is in the fact that the rod is fed at a speed of 35–300 m/s. Forming of waps with a variable diameter is realized under the influence of dynamic forces by means of rod declination at the wire-rod guide outlet at an angle of 15–80° with the axis of rotation and its following feeding in a curved concave path with rotation at an angle of 80–90° with the axis of wire-rod guide rotation, in this case speed of wire-rod guide rotation is varied with respect to the following ratio:

$$\omega \rangle \sqrt{0.465 \times \sigma_T},$$

where:
ω—angular speed of wire-rod guide rotation,
$\sigma_T$—yield point of rod material, A conveyer feeds the formed waps in the form of a flat spiral of a variable diameter for stacking in a stack. After stacking the coil should be bound.

A set of equipment is proposed to realize the applied method.

This invention enables to obtain a compact coil of high-quality rod with a high efficiency of the process.

27 Claims, 12 Drawing Sheets

FOREIGN PATENT DOCUMENTS

| | | | | | |
|---|---|---|---|---|---|
| EP | 0686439 | A1 | | 12/1995 | |
| EP | 0779115 | A1 | | 6/1997 | |
| EP | 0832701 | A1 | | 4/1998 | |
| EP | 0686438 | B1 | | 7/1998 | |
| GB | 1225420 | | | 3/1971 | |
| JP | 357056113 | A | * | 4/1982 | ..... 242/361.2 |
| JP | 362021423 | A | * | 1/1987 | ..... 242/361.2 |
| RU | 1412830 | A1 | | 7/1988 | |
| RU | 1438880 | A1 | | 11/1988 | |
| RU | 1606217 | A1 | | 11/1990 | |
| RU | 2046689 | C1 | | 10/1995 | |

* cited by examiner

"Prior Art"

"Prior Art"

"Prior Art"

*View B*

METHOD OF ROD COIL FORMING AND SET OF EQUIPMENT FOR ITS REALIZATION

This is a nationalization of PCT/RU01/00017, filed Jan. 17, 2001 and published in English.

This invention relates to rolling and in particular to the process of rod coil forming, for instance, of steel and nonferrous metals, and to a set of equipment for realization of it, as well as provides for production of a compact coil at a high speed of rolled metal feed.

Methods and devices of such type are presently used in rod production by rod mills. The main feature of the rod production process is thermal treatment to obtain a finished product with predetermined mechanical properties in particular with a predetermined uniform structure along the full length. Two-stage thermal treatment processes during which at the first stage a rod while linearly moving from a finishing stand is cooled with water in special sprayers and at the second stage it is cooled in the form of waps on a conveyer or roller conveyer while it is transported to a stack where waps are accumulated to form a coil are mostly widespread.

Provision of optimum conditions for secondary cooling of rods depends in many respects on the wap forming method (the first stage of coil forming process) and a set of equipment for it, as they are supposed to ensure even density of a spiral of waps placed on a conveyor to create equal conditions for cooling of each wap.

There exist methods of coil forming by means of rod feeding at a speed of up to 100 m/s, waps forming by means of a laying coiler, placement of waps on a conveyer and feeding them into a stack to accumulate them and to form, bind and pressurize a coil (see, for example, A. A. Kugushin, Yu. A. Popov, High-grade Rolling of Rod, M., Metallurgiya, 1982). The main feature of the known high-speed processes of rod production is the necessity of exact coordination of rolling speed (rod feed speed) and speed of laying coiler (wire-rod guide) rotation, that leads to forming of waps of actually the same diameter. As a result the coil made of waps of the same diameter is loose and has considerable sizes even after pressurization.

There exists a set of equipment for realization of the above method, which includes a laying coiler with a wire-rod guide, wap-forming head, drive motor, conveyer for feeding of rod waps to a stack where waps are accumulated and formed into a coil and a coil pressurization and binding device (see ibid). The coil forming head of the known device usually is a massive tapered case with which a spatially bent guide rigidly bonded (see also EP 0779115, IPC B21C 47/14, 16.06.97, DE 3819981, IPC B21C 47/10, 14.12.89). The internal diameter of a wire-rod guide (guide) of such devices is approximately 2–4% of the diameter of waps formed, so in case of mismatch of rod feed speed and speed of wire-rod guide rotation a jam of fed material and emergency shutdown of the process occur.

They tried to solve the problem of making a compact rod coil in high-speed processes through placing rod waps of the same diameter with eccentricity relative to the stack axis and even displacement of waps along a circle, in this case displacement of waps relative to the stack axis was realized both mechanically (see, for example, European patents Nos. 0686438, 0686439, IPC B21C 47/14, 22.07.98) and by means of rotary magnetic field (see Patent RU 2046689, IPC B21C 47/06, 27.10.95). The known methods enable to increase slightly the coil density, but they fail to obtain a dense and compact coil, as on displacement of waps before placing into a stack they lay in intersecting planes.

To displace rod waps mechanically the set of equipment at the conveyer outlet was equipped with various devices, for instance, with a device, which includes a stacking element and assembly with several rotary guide cams in the form of eccentrics determining a circle of waps passing in the process of rotation (see, for example, EP 0686438), or with a device displacing waps by a rotary plate with an opening being asymmetric relative to the stack center (see EP 0686439), or a device equipped with a crosspiece moving back and forth (see U.S. Pat. No. 4,747,557, IPC B21C 47/10, 47/18). All the above devices have a rather complicated design.

Layer spiral stacking of waps may eliminate imperfection of the known methods. The method of rod coil forming by a rod-coiling machine with a vertical take-up shaft, in this case the constantly fed material is stacked by waps along a spiral by horizontal layers throughout the height of a coil in parallel planes (see, for example, USSR Certificate of Authorship No. 1412830, IPC B21C 47/02, 30.07.88) (prior art). The shortcoming of the known method is, firstly, that it may be used at rod coiling machines with a vertical take-up shaft located directly above the stack for coil forming (see, Certificates of authorship No. 1438880, IPC B21C 47/02, 23.11.88, No. 1606217, IPC B21C 47/12, 15.11.90). These rod coiling machines operate at relatively low speeds of winding (approximately up to 20–30 m/s) and they cannot be used in processes with a rolling speed of 100 m/s and more, as at a high speed the vertical rod coiling machines create great resistance to metal fed. Secondly, such rod coiling machines stack rod waps directly into the stack omitting the stage of waps cooling importance of which was described above. Cooling of rod waps in a coil is uneven that affects the quality of material produced as in this case material has a nonuniform structure along the length.

The technical task solved by the applied invention is to make a compact coil of high-quality rod under a high efficiency of the coil forming process.

The set task is solved by means of the fact that a rod is fed at a speed of 35–300 m/s in the process of rod coil forming, which includes continuous rod feed through a wire-rod guide, forming of waps with a variable diameter by means of speed variation of wire-rod guide rotation and stacking of waps by horizontal layers throughout the height of a coil, and that forming of waps with a variable diameter is realized under the influence of dynamic forces by means of rod declination at the wire-rod guide outlet at an angle of 15–80° with the axis of rotation and consequent feeding it in a curved concave path with rotation at an angle of 80–90° with the axis of wire-rod guide rotation, in this case speed of wire-rod guide rotation is varied with respect to the following ratio:

$$\omega \rangle \sqrt{0.465 \times \sigma_T},$$

where:

$\omega$—angular speed of wire-rod guide rotation, $\sigma_T$—yield point of rod material, and waps in the form of a flat spiral are fed by conveyer for stacking in a separately located stack.

The diameter of waps is varied within a range of 600–1600 mm, in this case the rod may be a steel wire with a diameter of 5.5–14 mm or a nonferrous wire with a diameter of 6–18 mm.

Rod feeding along a curved concave path is provided through its feeding along a rotary curved quadric surface, for instance, as a hyperboloid.

Speed of wire-rod guide rotation is varied, for example, according to the following ratio:

$$\omega=\omega_0+at,$$

where:

$\omega_0$—initial speed of wire-rod guide rotation, a—factor depending on density of waps stacking;

t—time of rod coil forming.

The axis of wire-rod guide rotation may be located horizontally or at angle $\gamma$=3–10° with the horizontal plane.

Speed of wire-rod guide rotation is varied in compliance with the following ratio:

$$\omega = \omega_0 \pm \left(\frac{2V}{D_{ins}} - \frac{2V}{D_{out}}\right) \times \tau$$

where:

$$\omega_0 = \left(\frac{2V}{D_{ins}}\right),$$

V—speed of wire-rod guide feeding, $D_{ins}$—inside diameter of a coil, $D_{out}$—outside diameter of a coil, $\tau$—stacking time of one layer of waps.

According to this invention the method is realized by means of a set of equipment for rod coil forming, which includes a laying coiler with a wire-rod guide, wap-forming head and drive motor connected with each other, conveyer for feeding of rod waps to a stack where waps are accumulated and formed into a coil and coil binding device, the outlet end of the wire-rod guide of the laying coiler is bent at an angle of 15–80° with the axis of rotation, the wap-forming head is equipped with a dish made with a concave curved outer surface adjoining the edge of the bent end of the wire-rod guide and making an angle of 80–90° with the axis of rotation at the point being the most distant from the dish center, and the drive motor is equipped with a device for speed adjustment of wire-rod guide rotation.

The axis of wire-rod guide rotation may be located horizontally or at an angle of 3–10° with the horizontal plane, in this case the wire-rod guide may be made one-piece or consisting of two or more parts.

The wap-forming head is equipped with a protective case with cylindrical inner surface.

The device for wap pitch adjustment may be made in the form of a cone-shaped shell or in the form of a shell formed by mating curved surfaces with different diameters, enveloping the wap-forming head and installed coaxially with the wire-rod guide on a vertical support, in this case the support is designed with capability to move along the axis of wire-rod guide rotation and equipped with a drive.

The dish is installed coaxially with the wire-rod guide with capability to turn relative to it from one fixed position to another one in a turret way.

An opening of the bent end of the wire-rod guide has a round section and is made variable from the inlet to outlet, correspondingly from a circle to an ellipse, oriented with a longer axis perpendicular to the axis of wire-rod guide rotation.

The bent end of the wire-rod guide may be equipped with a roller or bush made of wear-resisting material. The roller is located at the wire-rod guide outlet on the side being remote from the axis of wire-rod guide rotation, and its generatrix is located on a tangent to the opening surface.

The outside surface of the dish may be a quadric surface, for instance, a hyperboloid.

The width of the conveyer is approximately equal to the stack diameter.

The applied method of rod coil forming allows, as distinct from the known methods, to make a compact coil at a high speed of rod feed and consequently at a high speed of coil forming. The upper limit of rod feed speed (300 m/s) is restricted in the applied method by a stretching force affecting on rod while wap forming. At speeds above 300 m/s a stretching force causes a change of the rod cross section, i.e. contraction of the section occurs. At a speed lower than 35 m/s the Coriolis force will be insufficient for rod plastic deformation and wap forming.

Unlike the abovementioned known methods wap forming according to the applied method is realized under the influence of forces affecting a rod while it goes out of the bent end of the wire-rod guide. In accordance with the known methods rods are fed from the wire-rod guide into the guide with a complicated spatial configuration, in this case the guide is rigidly connected with a massive support, for example, in the form of a taper (see, for instance, EP 0779115). This method of rod wap forming requires strict coordination of rod feed speed and speed of wire-rod guide rotation, otherwise a jam of rod in the guide and emergency shutdown of the equipment take place. In addition, large friction forces arise when rods are passing through the figured guide. In the applied method the centrifugal force and Coriolis force determining the rod curved path affect on the rod fed at an angle of 15–80° with the axis of wire-rod guide rotation and the rod have certain ductility on going out of the wire-rod guide. The rod going out of the wire-rod guide under the influence of the said forces slides arbitrarily on a concave curved surface changing its position depending on a speed of wire-rod guide rotation. Thus traction forces decrease considerably, and a change of speed of rotation becomes possible without a change of rod feed speed, and it enables to obtain rod waps with a variable radius of curvature.

The range of rotation angle of the bent end of the wire-rod guide of 15–80° is limited on the one hand by the load applied to the wire-rod guide, which inadmissibly increases on rotation at an angle more than 80°, or by the load applied to the dish which increases at an angle less than 15°. The further rotation of rod at an angle of 80–90° determines the wap pitch. In case of rotation at an angle less than 80° the wap pitch is too large, and if the angle more than 90° the waps will go to the reverse side (emergency situation).

Naturally, speed of wire-rod guide rotation is limited only by yield point $\sigma_T$ of rod material.

As distinct from the known method of waps forming (see USSR Certificate of authorship No. 1412830) according to the applied method the waps with a variable diameter formed in the form of a flat spiral are placed on the conveyer where they are evenly distributed and may be thermally treated, for instance, cooled. Then the waps drop in a separately located stack where they are stacked by horizontal layers without special operations. Compact coils of high-quality material may be obtained under the applied method by changing a speed of wire-rod guide rotation without coil pressurization.

The applied method is suitable for rods of any steel as well as of nonferrous metals, e.g. aluminum and copper.

The range of diameters of formed waps of 600–1600 mm is determined by the requirements to overall dimensions of the formed coil for their further use in technological processes.

The existing rod production processes determine choice of the range of steel rod diameters within the range of 5.5–14 mm. If a diameter is more than 14 mm speed of rolling decreases below the predetermined range. The process will not be a high-speed process, the same for nonferrous metals. An angle of inclination of 3–10° of the axis of wire-rod guide rotation with the horizontal plane improves conditions of rod waps laying on the conveyer.

As for the applied set of equipment, the known sets do not allow to realize the applied method. The applied set of equipment allows to refuse from complicated devices for displacement of rod waps before their stacking in a stack and from devices for coil pressurization.

Besides that, the applied set of equipment enables to obtain a rod coil, the breakdown back end of which has practically the same curvature as the waps of a wap spiral stacked in the stack.

This additional effect is due to the fact that the applied method of rod coil forming under the influence of dynamic forces enables to decrease a weight of the wap-forming head from 10–180 kg down to 30–40 kg, and consequently a length of the laying coiler from 3000 mm down to 800–1000 mm with the same bearings. As is well known, a length of the laying coiler has a direct influence on a curvature of the breakdown back end as the back end is only affected with fraction force $F_{fr}$ and unaffected with a propulsive force of the rollers feeding rod, i.e. friction work is equal to:

$$A=F_{fr}\times L$$

where:

L—length of laying coiler.

Therefore a decrease of the length of the laying coiler reduces detrimental friction work approximately by 3 times. In this case speed of the back end feed does not fall below the permissible value. On the other hand a reduction of the weight of the wap-forming head improves operation conditions of the laying coiler as well as increases reliability of operation of the whole set of equipment.

The essence of the invention is illustrated by Figures, which show:

FIG. 1—set of equipment for rod coil forming according to the known level of technology (prior art of the "device" object).

Figure 2:
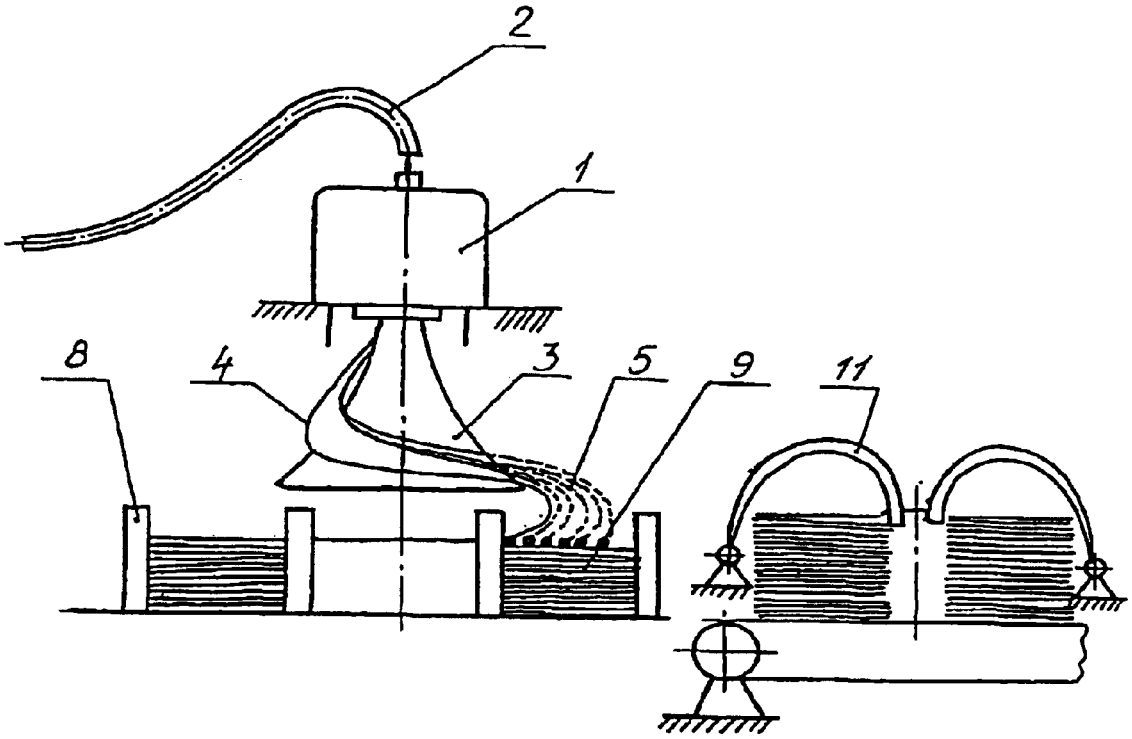

FIG. 2—device for rod coiling with a vertical take-up shaft according to the known level of technology (prior art of the "method" object).

Figure 3:
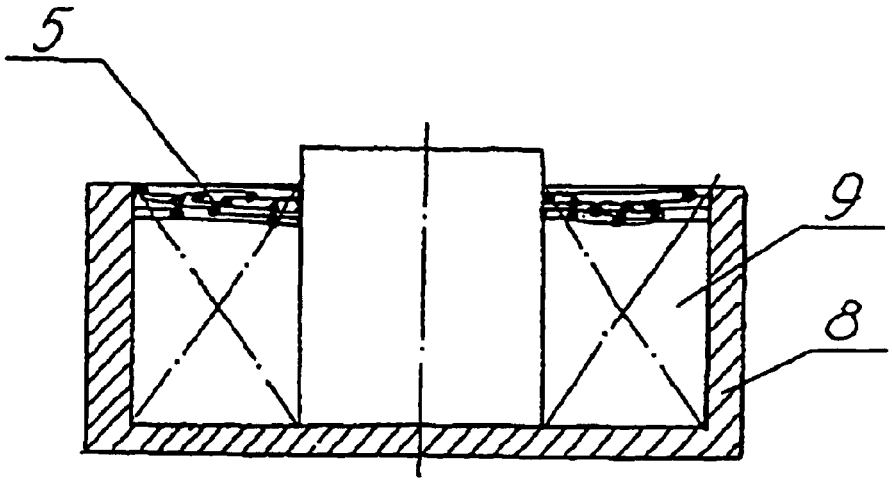

FIG. 3—rod coil made on the equipment according to FIG. 1, cross section.

Figure 4:
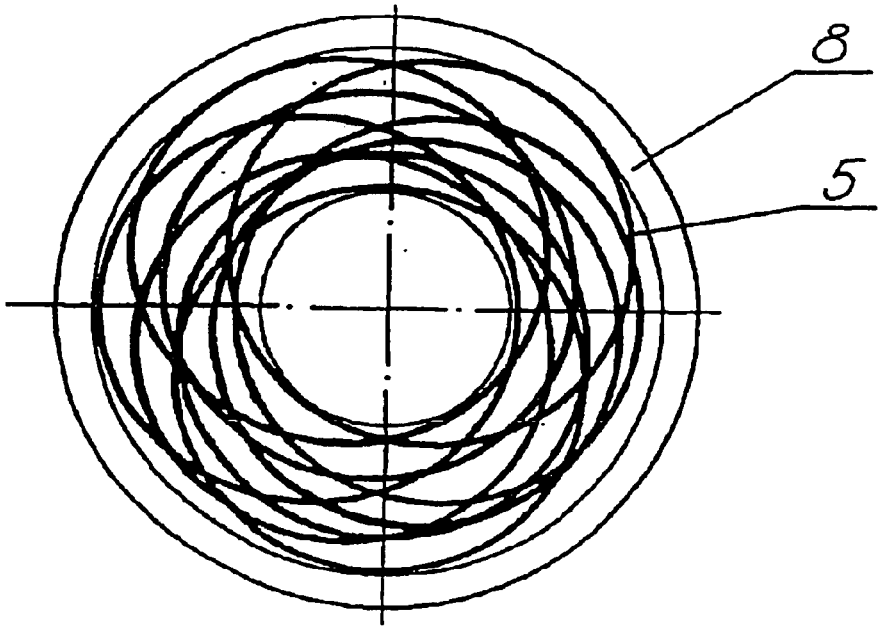

FIG. 4—idem, top view.

Figure 5:
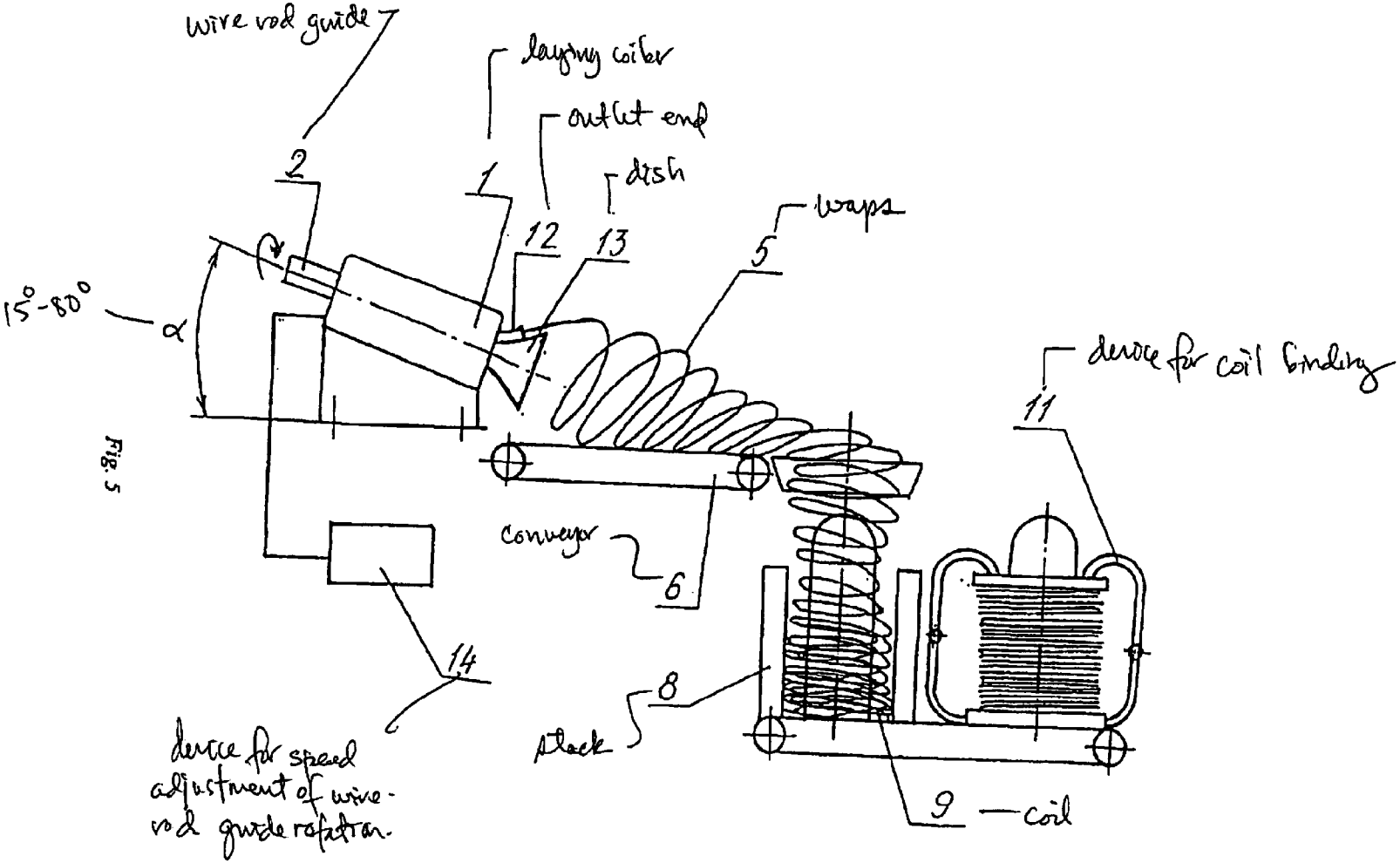

FIG. 5—set of equipment for rod coil forming according to this invention.

Figure 6:
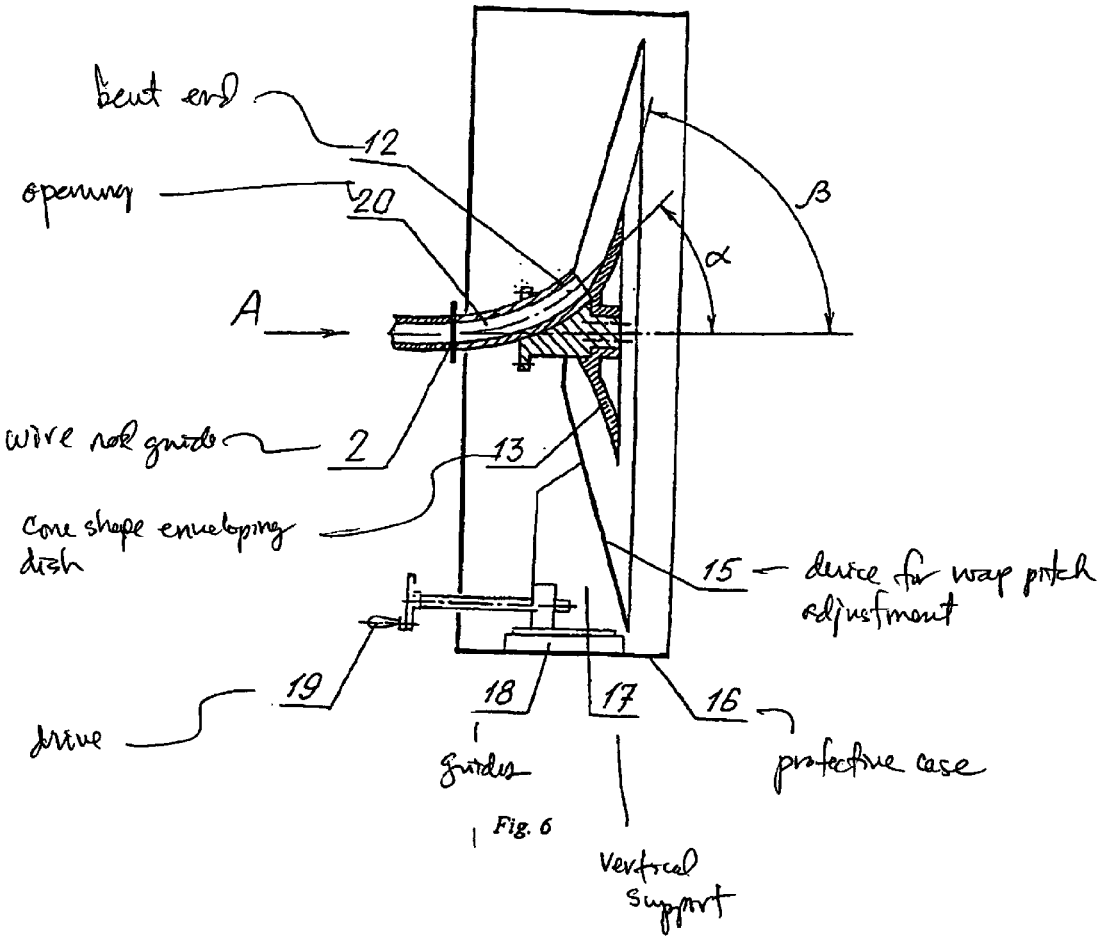

FIG. 6—laying coiler, general view.

Figure 7:
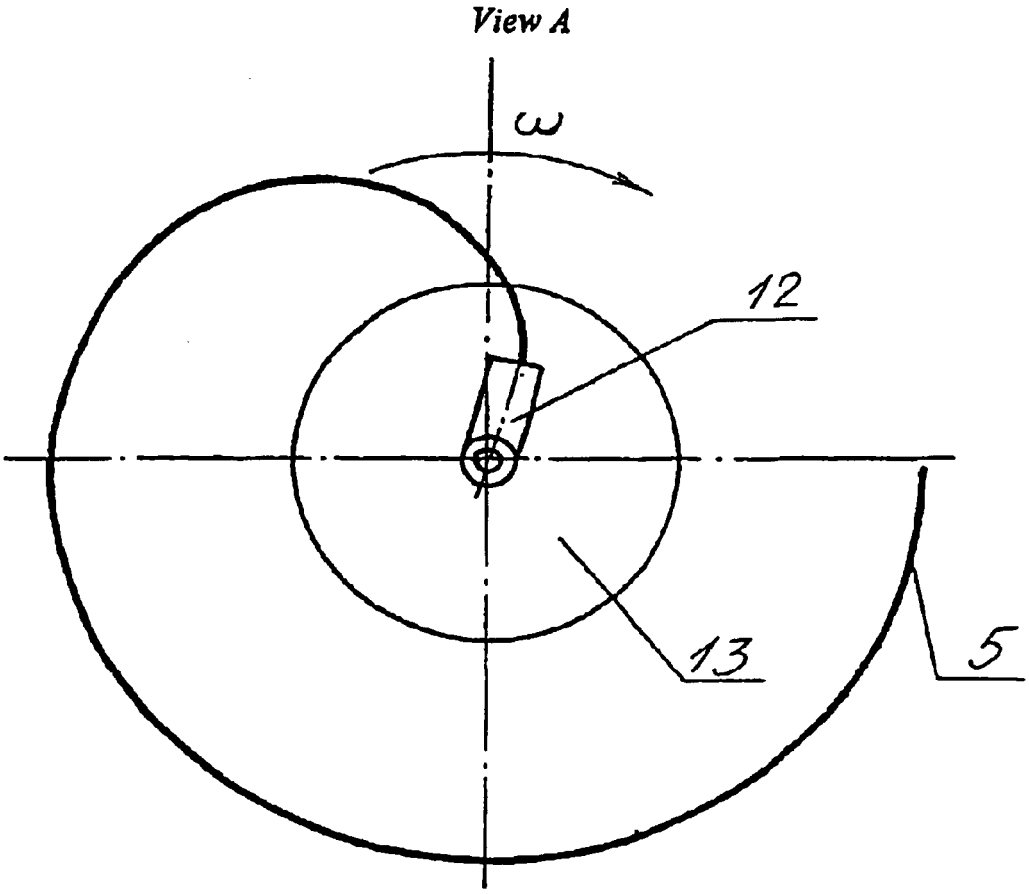

FIG. 7—idem, view A on FIG. 6.

Figure 8:
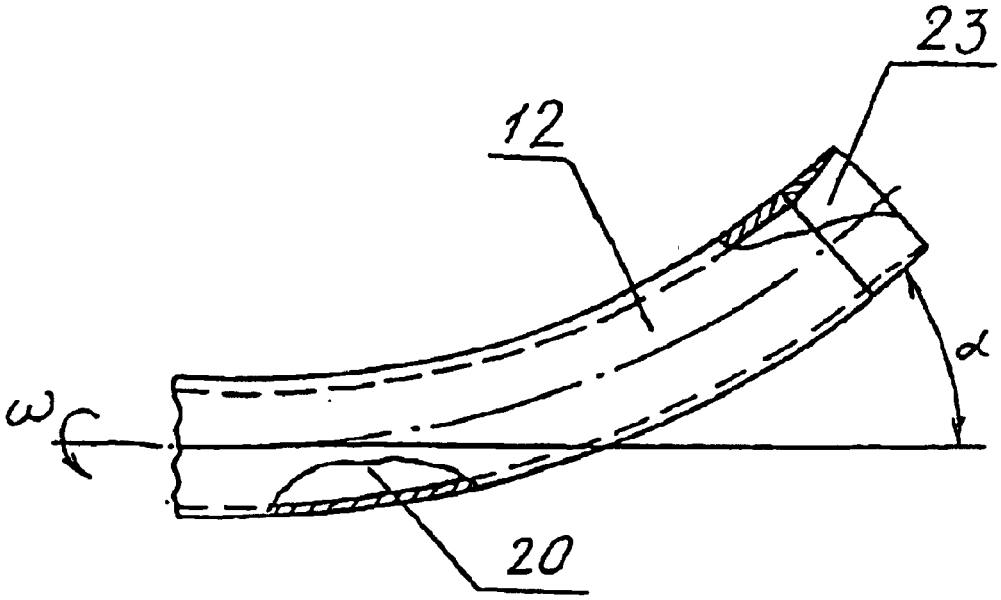

FIG. 8—the bent end of the wire-rod guide, front view.

Figure 9:
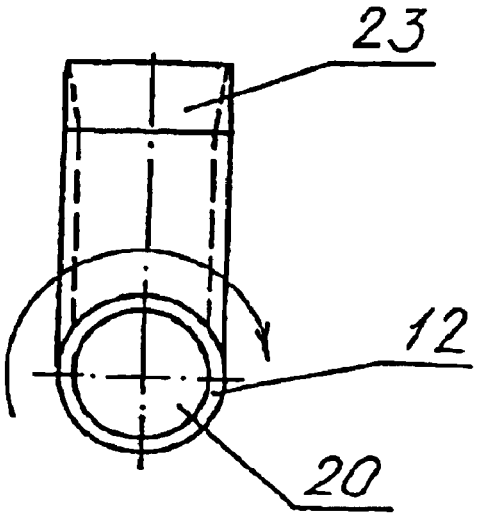

FIG. 9—idem, top view.

Figure 10:
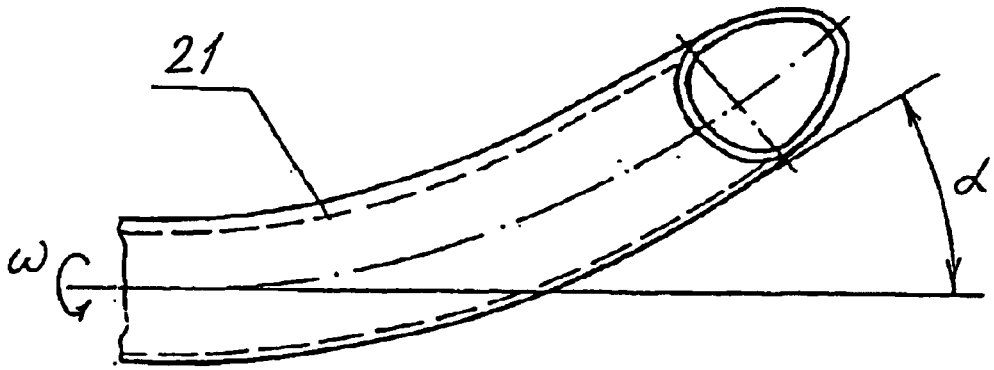

FIG. 10—idem, with section in the form of ellipse.

Figure 11:
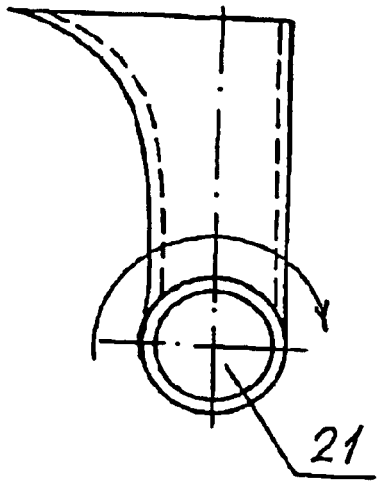

FIG. 11—idem, top view.

Figure 12:
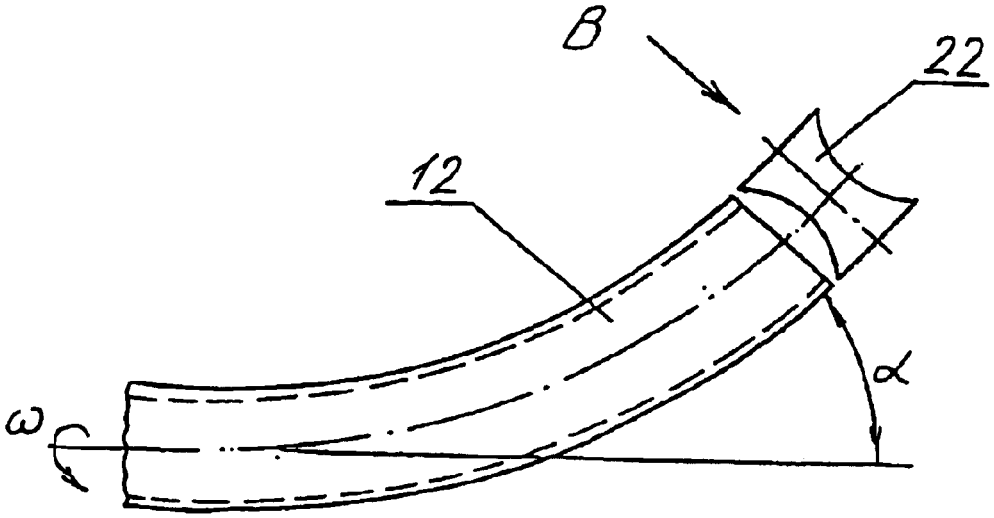

FIG. 12—the bent end of the wire-rod guide with a roller, front view.

Figure 13:
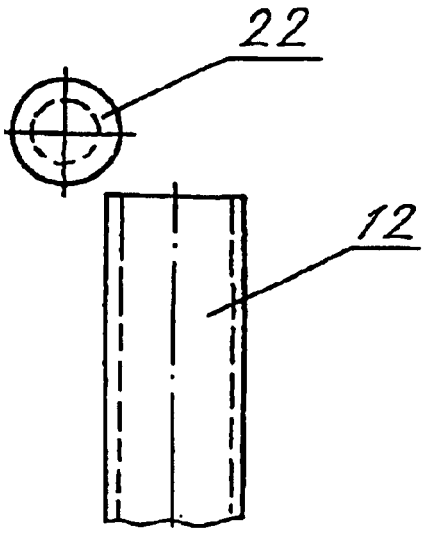

FIG. 13—idem, view B.

Figure 14:
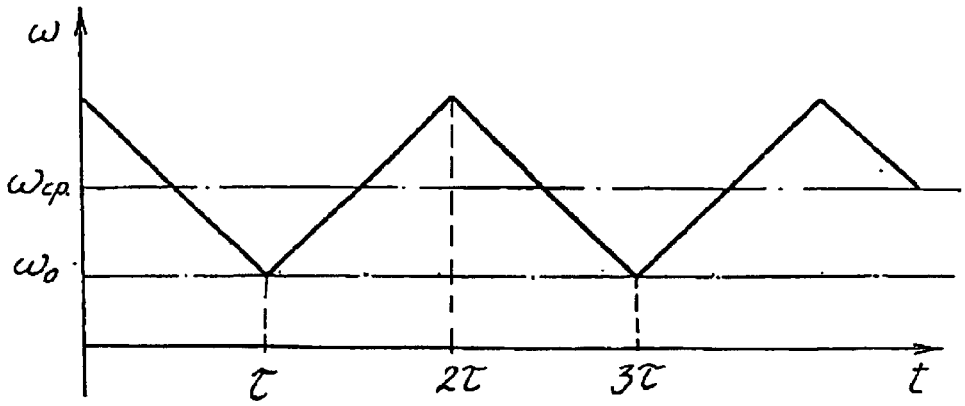

FIG. 14—speed curve of the wire-rod guide.

Figure 15:
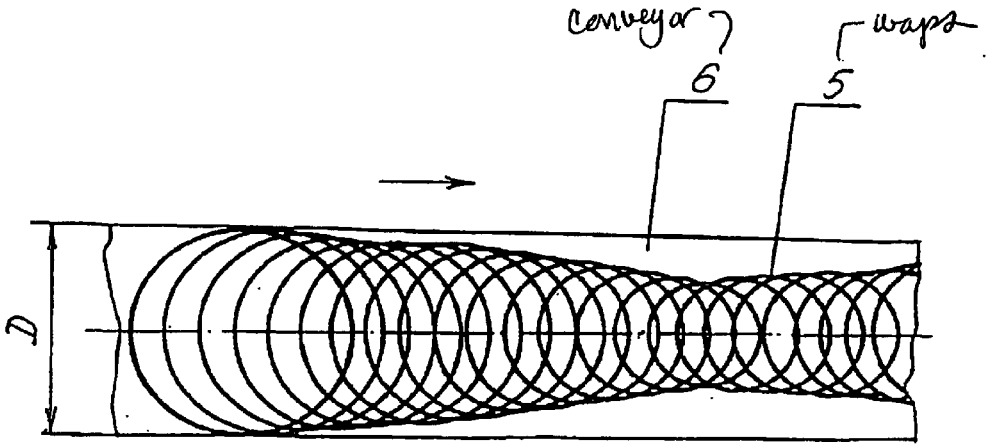

FIG. 15—rod waps on conveyer, top view.

Figure 16:
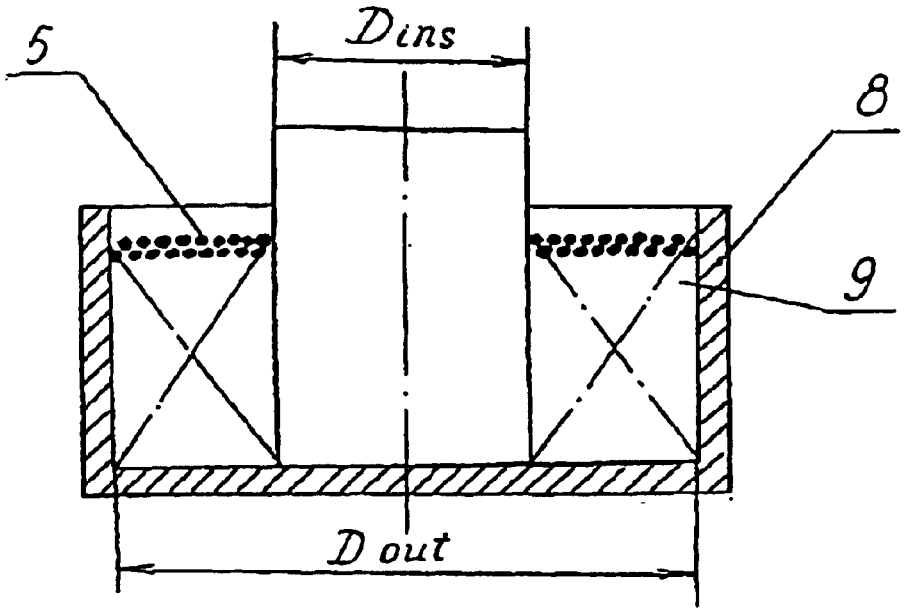

FIG. 16—rod coil made by the method according to this invention, cross section.

Figure 17:
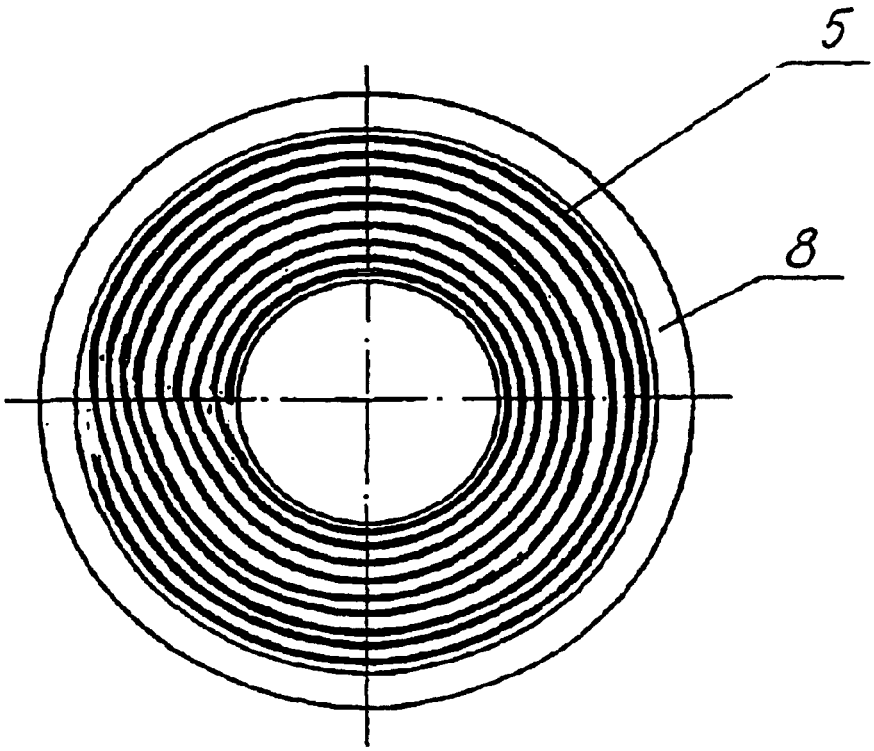

FIG. 17—idem, top view.

Figure 18:
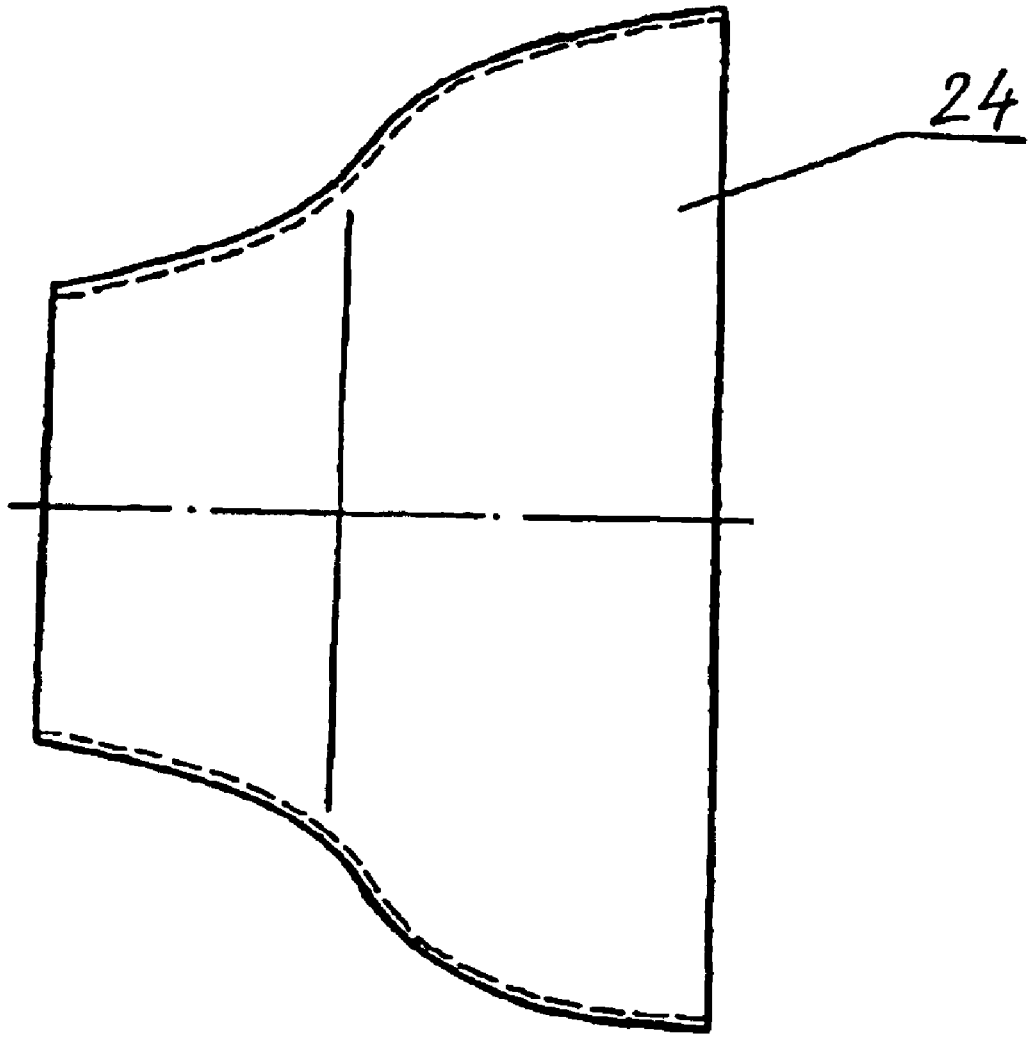

FIG. 18—shell of a device for wap pitch adjustment, the second option.

FIG. 1 shows the known set of equipment for rod coil forming, which includes a laying coiler 1 with a wire-rod guide 2, a wap-forming head containing a massive support 3 and curved guide 4 for rod passing and forming of waps 5, conveyer 6, device 7 for asymmetric distribution of waps, stack 8 for waps stacking in a coil 9 and device 10 for coil 9 pressurization and device 11 for coil 9 binding.

FIG. 2 shows the known device for rod coiling with a vertical take-up shaft is shown.

A set of equipment according to this invention (FIG. 5) includes a laying coiler 1 (identical elements of the known and applied sets of equipment are indicated with the same numbers of positions) with a wire-rod guide 2 with an outlet end 12, a wap-forming head and drive motor (not shown) connected with each other, a conveyer 6 for feeding of rod waps 5 to a separately located stack 8 for their accumulation and stacking in a coil 9 and a device 11 for coil 9 binding. The outlet end 12 of the wire-rod guide 2 is bent at angle a equal to 15–80° with the axis of the wire-rod guide rotation. The wap-forming head is equipped with a dish 13 made with a concave curved outer surface adjoining the edge of the bent end 12 of the wire-rod guide 2 and making angle β equal to 80–90° with the axis of wire-rod guide rotation at the point being the most distant from the center of the dish 13. The drive motor of the laying coiler is equipped with a device 14 for speed adjustment of wire-rod guide rotation. The laying coiler 1 is equipped with a device 15 for wap pitch adjustment. The wire-rod guide may be located horizontally or at angle γ equal to 3–10° with the horizontal plane. The wire-rod guide 2 may be made one-piece or consisting of two or more parts, for instance, of a rectilinear part and bent end connected by means of releasable connection. The wap-forming head is equipped with a protective case 16 with cylindrical inner surface. The device 15 for wap pitch adjustment may be made in the form of a cone-shaped shell enveloping the dish 13 and installed coaxially with the wire-rod guide 2 on a vertical support 17. The support 17 is designed with capability to move on guides 18 along the axis of rotation of the wire-rod guide 2 and equipped with a drive 19. A shell of the device 15 may be made of mating curved surfaces as shown on FIG. 18. The dish 13 is installed coaxially with the wire-rod guide 2 with capability to turn relative to it from one fixed position to another one in a turret way, i.e. by means of the known turret mechanism. An opening 20 of the bent end 12 of the wire-rod guide 2 may have a round section as shown on FIGS. 8 and 9, or it may be made variable from the inlet to outlet, correspondingly from a circle 20 to an ellipse 21, oriented with a longer axis perpendicular to the axis of rotation of the wire-rod guide 2 (FIGS. 10 and 11). The outside surface of the dish 13 may be conjugated with surface of the opening 20 on a tangent. The bent end 12 of the wire-rod guide 2 may be equipped with a roller 22 located at the wire-rod guide outlet on the side being the most remote from the axis of rotation of the wire-rod guide 2, and its generatrix is located on a tangent to the inner surface of the opening 20. The bent end 12 may be equipped with a bush 23 made of wear-resisting material. Width D of the conveyer 6 for feed of rod waps 5 is equal to the diameter of the stack 8 and correspondingly to the maximum diameter of a coil.

Operation of the device will be described by way of example of the method application.

The rod with diameter d=10 mm of steel 3 at a temperature of 600° C. ($\sigma_T$=190 MPa) was fed at rolling speed V=52.95 m/s into the wire-rod guide 2. Angular speed ω of wire-rod guide rotation was varied according to the ratio (FIG. 13):

$$\omega = \omega_0 \pm \left(\frac{2V}{D_{ins}} - \frac{2V}{D_{out}}\right) \times \tau$$

where:

$$\omega_0 = \left(\frac{2V}{D_{ins}}\right),$$

V=52.95 m/s, $D_{out}$—outside diameter of a coil equal to 1040 mm, $D_{ins}$—inside diameter of a coil equal to 600 mm, τ—stacking time of one layer of waps equal to 1.038 s.

In this case the ratio, according to which speed of wire-rod guide rotation was varied, was the following:

$$\omega=176.5\pm74.7\times\tau, \text{ where: } 0<t<\tau.$$

The minimum speed of wire-rod guide rotation was checked according to the ratio:

$$\omega \rangle \sqrt{0.465 \times \sigma_T},$$

$$\omega_{\min} = \omega_{out} = 176.5 \rangle \sqrt{0.465 \times 190} = 9.4 \text{ s}^{-1},$$

Number of waps in layer n was:

$$n = \frac{D_{out} - D_{ins}}{2d} = 22 \text{ waps}$$

In this case coil length 1 in the layer was:

$$l = n2\pi \frac{D_{out} - D_{ins}}{2d} = 113.3 \text{ m}$$

With coil height H=1000 mm number of layers k is equal to H/d=100, and rod length L in the coil is equal to L=lk=113300 m.

The rod was fed into the wire-rod guide 2, the end 12 of which was bent at angle α=10° with the axis of wire-rod guide rotation, and further was turned at angle β=87° along the dish 13 made in the form of a hyperboloid.

Waps 5 were laid on the conveyer 6 (FIG. 15) and as a flat spiral with a variable diameter were cooled and then stacked in the separately located stack 8 to form a coil 9. The finished coil 9 was bound by means of the device 11.

Comparison of rod coils produced by the known set of equipment with a device for asymmetric waps distribution at the conveyer outlet and the applied set of equipment proved that the density of the coil formed by the applied method increased by 40–50% as compared to the known one. Tests of mechanical properties of material showed that the rod made by the method according to this invention had even mechanical properties along the full length.

What is claimed is:

1. The method of rod coil forming including continuous rod feeding through a wire-rod guide, forming of waps with a variable diameter by means of variation of speed of wire-rod guide rotation and stacking of waps by horizontal layers throughout the height of a coil, distinguished by the fact that the rod is fed at a speed of 35–300 m/s, forming of waps with a variable diameter is realized under the influence of dynamic forces by means of rod declination at the wire-rod guide outlet at an angle of 15–80° with the axis of rotation and its following feeding in a curved concave path with rotation at an angle of 80–90° with the axis of wire-rod guide rotation, in this case speed of wire-rod guide rotation is varied with respect to the following ratio:

$$\omega \rangle \sqrt{0.465 \times \sigma_T},$$

where:

ω—angular speed of wire-rod guide rotation, $\sigma_T$—yield point of rod material, and waps in the form of a flat spiral are fed by conveyer for stacking in a separately located stack.

2. The method as provided for by claim 1 distinguished by the fact that a diameter of waps is varied within a range of 600–1600 mm.

3. The method as provided for by claim 1 distinguished by the fact that the rod is a steel wire with a diameter of 5.5–14 mm.

4. The method as provided for by claim 1 distinguished by the fact that the rod is a nonferrous wire with a diameter of 6–18 mm.

5. The method as provided for by claim 1 distinguished by the fact that rod feeding in a curved concave path is provided through feeding it along a rotary curved quadric surface.

6. The method as provided for by claim 5 distinguished by the fact that the quadric surface is a hyperboloid.

7. The method as provided for by claim 1 distinguished by the fact that speed of wire-rod guide rotation is varied according to the following ratio:

$$\omega=\omega_0+at,$$

where:

$w_0$—initial speed of wire-rod guide rotation, a—factor depending on density of waps stacking;

t—time of rod coil forming.

8. The method as provided for by claim 1 distinguished by the fact that the axis of wire-rod guide rotation is located horizontally.

9. The method as provided for by claim 1 distinguished by the fact that the axis of wire-rod guide rotation is located at an angle of 3–10° with the horizontal plane.

10. The method as provided by claim 1 distinguished by the fact that speed or wire-rod guide rotation is varied in compliance with the following ratio:

$$\omega = \omega_0 \pm \left(\frac{2V}{D_{ins}} - \frac{2V}{D_{out}}\right) \times \tau$$

where:

$$\omega_0 = \left(\frac{2V}{D_{ins}}\right),$$

V—speed of wire-rod guide feeding, $D_{ins}$—inside diameter of a coil, $D_{out}$—outside diameter of a coil, t—stacking time of one layer of waps.

11. The set of equipment for rod coil forming, which includes a laying coiler with a wire-rod guide, wap-forming head and drive motor connected with each other, conveyer for feeding or rod waps to a stack where waps are accumulated and formed into a coil and device for coil binding distinguished by the fact that the outlet end of the wire-rod guide of the laying coiler is bent at an angle of 15–80° with the axis of rotation, the wap-forming head is equipped with a dish made with a concave curved outer surface adjoining the edge of the bent end of the wire-rod guide and forming an angle of 80–90° with the axis of rotation at the point being the most distant from the dish center, and a drive motor is equipped with a device for speed adjustment of wire-rod guide rotation.

12. The set of equipment as provided for by claim 11 distinguished by the fact that the laying coiler is equipped with a device for wap pitch adjustment.

13. The set of equipment as provided for by claim 11 distinguished by the fact that the axis of wire-rod guide rotation is located horizontally.

14. The set of equipment as provided for by claim 11 distinguished by the fact that the axis of wire-rod guide rotation is located at an angle of 3–10° with the horizontal plane.

15. The set of equipment as provided for by claim 11 distinguished by the fact that the wire-rod guide is made of two or more parts.

16. The set of equipment as provided for by claim 11 distinguished by the fact that the wap-forming head is equipped with a protective case with cylindrical inner surface.

17. The set of equipment as provided for by claim 11 distinguished by the fact that the device for wap pitch adjustment is made in the form of a cone-shaped shell enveloping the wap-forming head and installed coaxially with the wire-rod guide on a vertical support, in this case the support is designed with capability to move along the axis of wire-rod guide rotation and equipped with a drive.

18. The set of equipment as provided for by claim 11 distinguished by the fact that the device for wap pitch adjustment is made in the form of a shell formed by mating curved surfaces with different diameters enveloping the wap-forming head and installed coaxially with the wired-rod guide on a vertical support, in this case the support is designed with capability to move along the axis of wire-rod guide rotation and equipped with a drive.

19. The set of equipment as provided for by claim 11 distinguished by the fact that the dish is installed coaxially with the wire-rod guide with capability to turn relative to it from one fixed position to another one in a tunet way.

20. The set of equipment as provided for by claim 11 distinguished by the fact that the opening of the bent end of the wire-rod guide has a round section.

21. The set of equipment as provided for by claim 11 distinguished by the fact that section of the opening of the bent end of the wire-rod guide is made variable from the inlet to outlet, correspondingly from a circle to an ellipse, oriented with a longer axis perpendicular to the axis of wire-rod guide rotation.

22. The set of equipment as provided for by claim 11 distinguished by the fact that the said outside surface of the dish is conjugated with the opening surface of the bent end of the wire-rod guide on a tangent.

23. The set of equipment as provided for by claim 11 distinguished by the fact that the bent end outlet of the wire-rod guide is equipped with a bush made of wear-resisting material.

24. The set of equipment as provided for by claim 11 distinguished by the fact that the bent end outlet of the wire-rod guide is equipped with a roller located at the wire-rod guide outlet on the side being the most remote from the axis of wire-rod guide rotation, and its generatrix is located on a tangent to inner surface of the opening.

25. The set of equipment as provided for by claim 11 distinguished by the fact that the outside surface of the dish is a quadric surface.

26. The set of equipment as provided for by claim 25 distinguished by the fact that the outside surface of the dish is a hyperboloid.

27. The set of equipment as provided for by claim 11 distinguished by the fact that the width of the conveyer for feed of rod waps is approximately equal to the stack diameter.

* * * * *